United States Patent [19]

Henderson

[11] 4,231,200

[45] Nov. 4, 1980

[54] METHOD AND APPARATUS FOR ASSEMBLING A PORTABLE TOWER

[76] Inventor: Dennis Henderson, c/o Netco Systems, S. Highway 36, Caddo Mills, Tex. 75005

[21] Appl. No.: 896,927

[22] Filed: Apr. 17, 1978

[51] Int. Cl.[2] ..... E04H 12/34

[52] U.S. Cl. ..... 52/111; 52/117; 52/123; 182/19

[58] Field of Search ..... 52/111, 117, 123; 182/40, 41, 19

[56] References Cited

U.S. PATENT DOCUMENTS

| | | | |
|---|---|---|---|
| 2,857,994 | 10/1958 | Sheard | 52/123 |
| 2,863,531 | 12/1958 | Campbell | 52/123 |
| 2,998,106 | 4/1961 | Aust | 52/123 |
| 3,150,740 | 9/1964 | Rabeli | 52/111 |
| 3,606,713 | 9/1971 | Ranquist | 52/118 |
| 3,684,056 | 4/1972 | Penso | 182/19 |

FOREIGN PATENT DOCUMENTS

| | | | |
|---|---|---|---|
| 440360 | 2/1927 | Fed. Rep. of Germany | 52/111 |
| 201047 | 1/1966 | Sweden | 52/111 |
| 465086 | 4/1937 | United Kingdom | 52/111 |
| 572557 | 9/1977 | U.S.S.R. | 52/111 |

*Primary Examiner*—James A. Leppink
*Assistant Examiner*—Henry E. Raduazo
*Attorney, Agent, or Firm*—Hubbard, Thurman, Turner, Tucker & Glaser

[57] ABSTRACT

Method and apparatus for transporting a sectional tower to a selected location and for erecting the tower at the selected location is disclosed. The apparatus includes a mobile trailer bed on which the erection apparatus and the tower sections are transported. A frame is carried on the trailer bed which has racks on which a number of tower sections are stowed. A folding guide member is pivotally attached to the trailer frame and is rotatable to a stowed position during transportation and is rotatable to an upright position for guiding the tower during erection. A hoist is carried on the folding guide member for raising the tower sections through the guide member. A plurality of sheaves are attached to the support frame and upon a number of anchors symmetrically disposed at radially spaced locations relative to the support frame. Guy wires are attached to the uppermost tower section and are reeved with the sheaves associated with each anchor and are coupled to a winch. The uppermost tower section is raised to an elevated position on the guide member while additional lengths of guy wire are fed out under tension as the tower section is extended. The next succeeding tower section is connected to the uppermost tower section in end-to-end relation while maintaining the guy wires under tension. Thereafter, the assembled tower sections are raised through the upright guide member by applying a hoisting force to the lowermost tower section while feeding out additional lengths of guy wire under tension as the assembled tower is extended. These steps are repeated until each of the remaining tower sections have been assembled and the tower has been fully extended.

3 Claims, 12 Drawing Figures

METHOD AND APPARATUS FOR ASSEMBLING A PORTABLE TOWER

BACKGROUND OF THE INVENTION

1. Field of the Invention

The present invention relates generally to the erection of sectional towers, and more particularly to method and apparatus for erecting a portable sectional tower of the type used in communication systems.

2. Description of the Prior Art

There are a number of important industrial and military field operations in which it is necessary to transport a portable communications tower to a remote field location, erect the tower, establish a temporary communications center during a temporary operation, and then move to a new location. Three important considerations for such operations are safety, economy, and mobility. In regard to safety considerations, one of the most hazardous aspects of tower erection is the requirement for climbing the tower to attach communications equipment. Safety can be greatly improved if the attachment of equipment such as guy wires, antennas, coax cables and antenna assemblies can be done at or near ground level so that tower climbing is eliminated. This is especially important when operating in remote field locations in cold and windy weather. Among the economic considerations are the auxiliary equipment and personnel required to carry out the tower erection. When operating in remote field locations, it would be desirable to minimize the number of attendants and operators necessary for carrying out the erection, and furthermore to reduce the number of steps and to minimize the auxiliary equipment required. Such arrangements are also desirable in that it would eliminate the requirement for the hiring and support of a large number of tower erection personnel and also would eliminate the costly and time consuming training. Finally, mobility is an important consideration for certain field operations in which it is necessary to transport a communications tower to a remote location, erect the tower, set up and operate a communications center during a temporary operation, and then disassemble the tower and transport it to a new field location.

A great number of accidents involving the collapse of the tower have occurred because of improper guy wire support. Because of the wind loading effect, it is important that a communication tower be provided with guy wire support during erection as well as after it is fully extended. Therefore, the tower erection procedure has proven to be difficult and dangerous unless a large number of personnel are available to tighten and secure the guy wires simultaneously and uniformly as the tower is erected. Such a requirement is obviously incompatible with conventional portable towers, especially when operating in remote field locations. The safety and economy considerations are equally important when the portable tower is disassembled.

Therefore, it is an important object of the present invention to provide apparatus for erecting a portable sectional tower which includes means for automatically and simultaneously applying a tension load to the guy wires as the tower is erected, thereby eliminating the need for a separate, manually supervised tightening operation.

It is another object of the present invention to provide portable erection apparatus in which tower sections are extended successively from the ground level up so that the attachment guy wires and antenna equipment can be carried out at near ground level whereby tower climbing is practically eliminated.

It is a further object of the present invention to provide a self-contained mobile carriage assembly on which sectional tower members may be transported to a remote location and from which the tower sections may be safely erected by a minimum number of personnel.

SUMMARY OF THE INVENTION

The foregoing and other objects are carried out by apparatus which includes a mobile trailer bed having a frame and racks in which a number of tower sections are stowed. Pivotally attached to the trailer frame is a folding guide member which is rotatable to a stowed position during transportation and which is rotatable to an upright position for guiding the tower sections during erection. Hoist means are carried on the folding guide member for raising the tower sections as they are assembled one-by-one. A number of sheaves are attached to the support frame and to a corresponding number of anchors which are symmetrically disposed at regularly spaced ground locations relative to the support frame. A plurality of guy wires are attached to the upper tower section and to a winch with intermediate portions of the sheaves being coupled in reeved engagement with the sheaves so that a tension load can be applied to the guy wires as the tower sections are extended or retracted.

After the uppermost tower section is inserted into the upright guide member, the guy wires are attached to the tower section and are coupled to the guide member sheaves and anchor sheaves. Thereafter, the uppermost tower section is extended through the upright guide member while additional lengths of guy wire are fed out under tension. The next succeeding tower section is then attached to the uppermost tower section in end-to-end relation while the guy wires are maintained under tension. The assembled tower sections are then raised through the upright guide member by applying a hoisting force to the lowermost tower section while feeding out additional lengths of guy wire under tension as the assembled tower section is extended. These steps are repeated until each of the remaining tower sections have been assembled and the tower has been fully extended.

The tower sections are guyed under tension from the ground up so that the tower is supported against wind loading at all times. Furthermore, because the uppermost tower section is initially supported on the upright guide member and trailer frame, the uppermost guy wires can be safely attached to a relatively low elevation. The antenna components can also be safely attached to the uppermost tower section while it is supported by the upright guide member and guy wires thereby substantially eliminating tower climbing. Since the guy wires are tensioned under positive winch control at all times, several operators are not required. Because of the simple erection procedure and safety features, an experienced equipment operator and one assistant can operate the erection equipment safely after only one demonstration. Additionally, because the uppermost guy wires are maintained under tension at all times, the tower can be disassembled in reverse order with complete safety.

The foregoing and other objects, advantages and features of the invention will hereinafter appear, and for purposes of illustration, but not of limitation, an exemplary embodiment of the subject invention is shown in the various views of the appended drawings.

DETAILED DESCRIPTION

Figure 1:
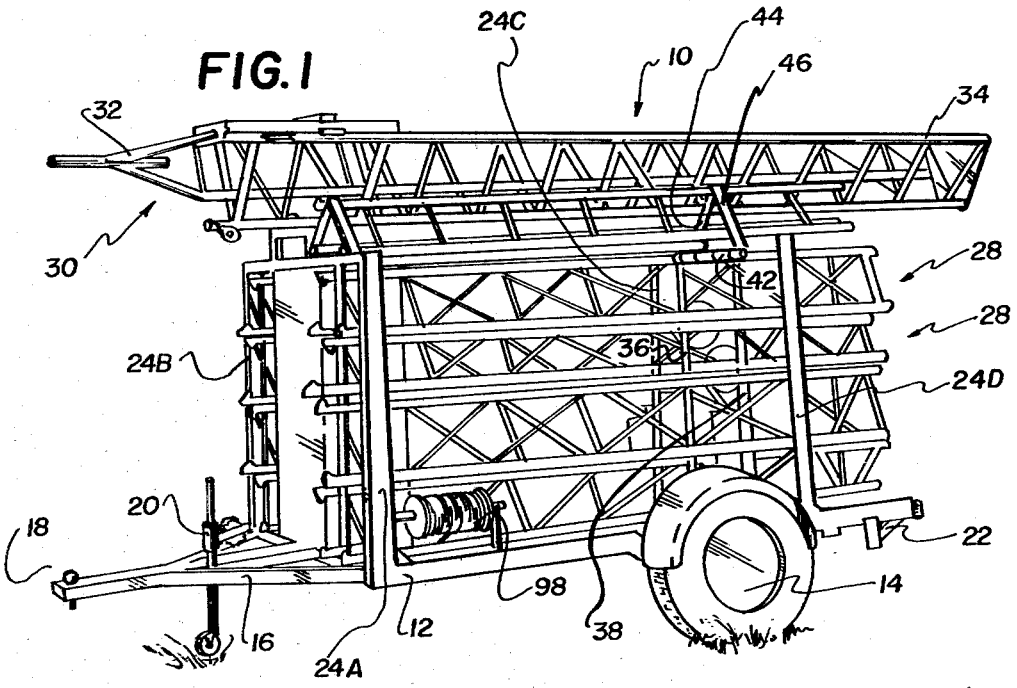
FIG. 1 is an isometric view of a trailer assembly on which sections of a portable tower and the erection apparatus of the invention are disposed.

In the description which follows, like parts are marked throughout the specification and drawing with the same reference numerals, respectively.

Referring now to the drawing, FIG. 1 illustrates the tower erection apparatus of the present invention, generally designated by the numeral 10. The tower erection apparatus 10 includes a horizontal chassis or frame member 12 supported on a rear wheel and axle assembly 14 for mobility. The forward end of the frame 12 has side members 16 which converge at a hitch 18 so that the erection apparatus may be towed by a truck or other vehicle. The forward end of the frame 12 carries a conventional jack 20 which is extensible to support the apparatus when the hitch 18 is not connected to a towing vehicle. Rear jacks 22 are adjustable to engage the ground to stabilize the erection apparatus 10 in operation. The combination of the wheel and axle assembly 14 with the chassis 12 constitutes a mobile, single axle trailer assembly on which the tower erection apparatus 10 is transported.

According to an important feature of the invention, the tower erection apparatus 10 includes all of the erection equipment and parts necessary to erect a sectional communications tower at a remote field location. In particular, the chassis 12 is provided with upright frame members 24A, 24B, 24C and 24D each of which is provided with horizontal rack members 26 which in combination with the frame members enclose and support a number of identical tower sections 28. Secured to the top of the upright frame members is an uppermost tower section 30 to which an antenna mounting bracket 32 is welded. The antenna mounting bracket 32 may be of conventional construction for receiving a microwave dish installation or a whip antenna.

Figure 2:
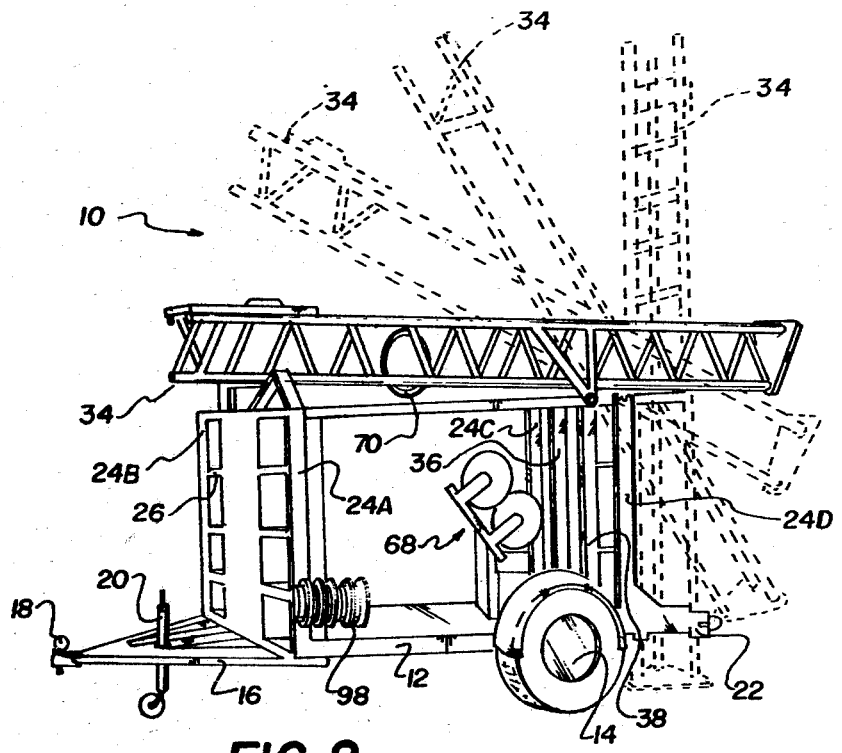
FIG. 2 is a view similar to FIG. 1 which illustrates the rotation of an upright guide frame from a stowed position to an upright position.

Referring now to FIGS. 1 and 2, the tower erection apparatus 10 includes a folding guide member 34 pivotally attached to a pair of upright frame members 36, 38 which are disposed intermediate the rear upright frame members 24C, 24D. The folding guide member 34 is pivotally attached to a cross-bar weldment 40 which extends horizontally between the upright frame members 36, 38. The folding guide member 34 is rotatably coupled to the cross-bar weldment 40 by means of a sleeve bearing member 42 which circumscribes the cross-bar weldment member 40. Transverse brace members 44, 46 couple the guide member 34 to the sleeve bearing member 42.

Figure 3:
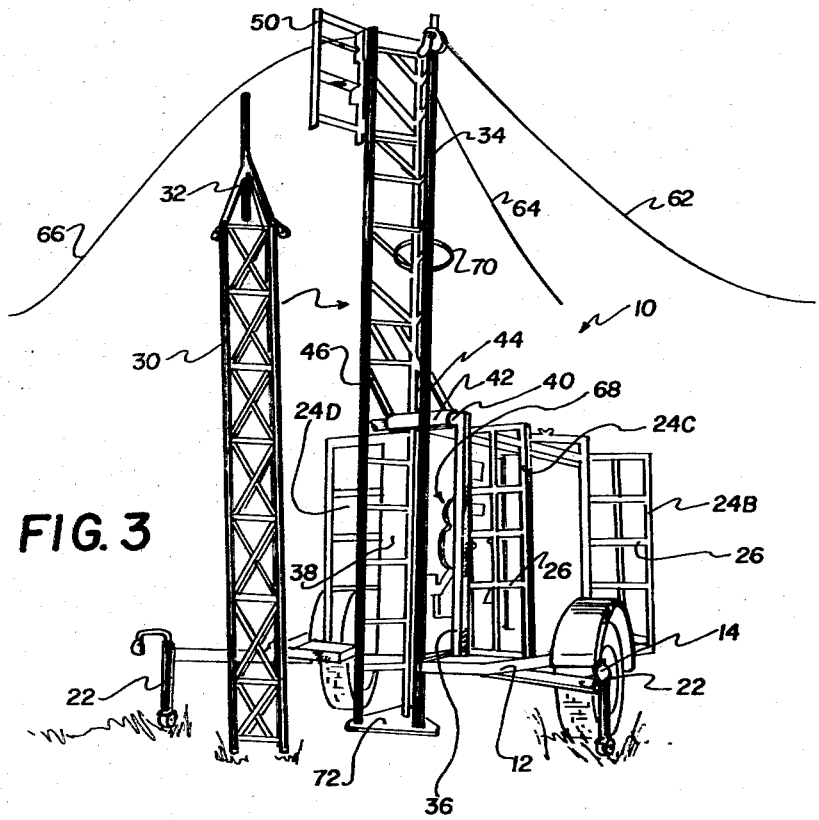
FIG. 3 is a rear perspective view of the trailer assembly shown in FIG. 2.

The folding guide member 34 is transported in a stowed position as shown in FIG. 1 and is rotatable from the stowed position to an upright position for erecting a communications tower as shown in FIGS. 2 and 3 of the drawing.

Figure 4:
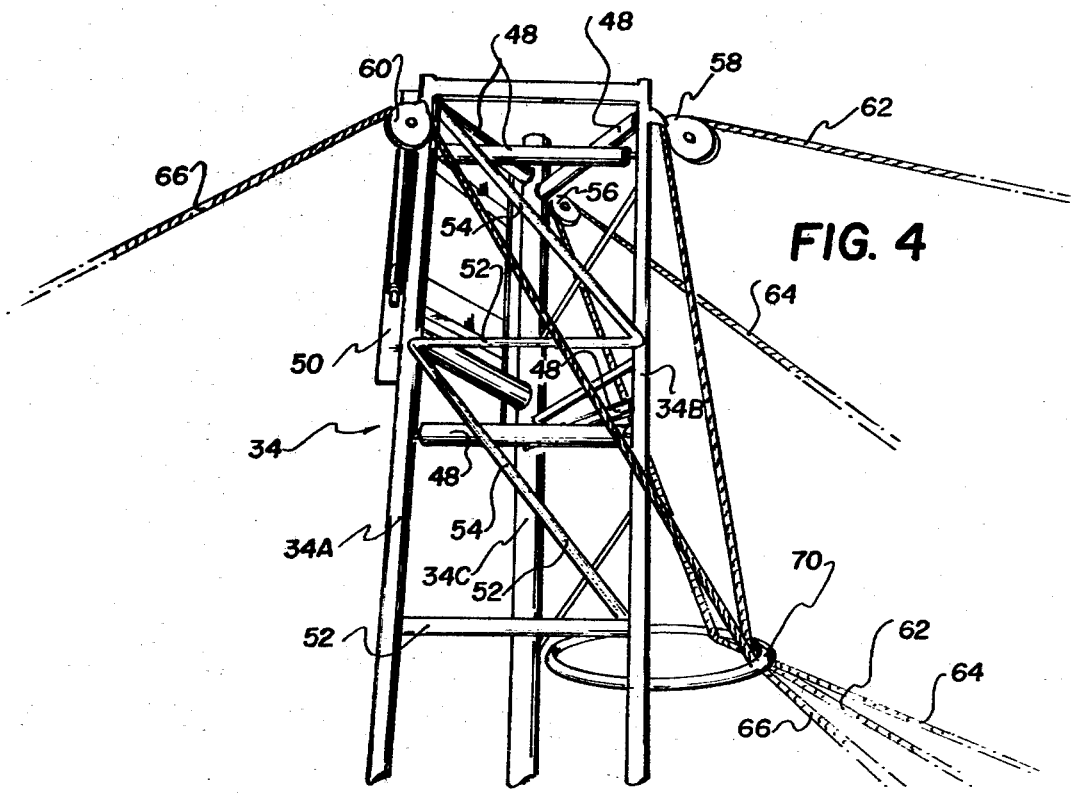
FIG. 4 is a perspective view of an upper section of the guide member shown in FIG. 3.

Referring now to FIGS. 3 and 4, the folding guide member 34 is constructed in the form of an elongated triangular section in a manner similar to the construction of the tower sections 28. However, it is longer than each tower section and slightly larger in diameter so that the tower sections 28, 30 can be inserted into the guide member for support during the tower erection procedure. According to a preferred embodiment, the tower sections 28 are ten feet in length and the folding guide member 34 is fifteen feet in length. Mounted on an upper section of the folding guide member 34 are a plurality of rollers 48 disposed on each side of the folding guide member at axially spaced locations. One side of the guide member 34 is left open to permit individual tower sections 28 to be inserted inside of it. The purpose of the rollers is to prevent binding of the tower sections 28 against the guide member 34 as they are hoisted during the erection procedure. A gate 50 is attached to the upper portion of the folding guide member 34 and is closed during the tower erection procedure. The gate 50 may be opened if desired after the tower has been erected to permit the tower erection apparatus 10 to be withdrawn in the case of a permanent tower installation. Additionally, it may be desirable to open the gate 50 during the initial insertion of the uppermost tower section 30 to provide clearance for the antenna mounting bracket assembly 32. However, during the erection procedure, the gate is secured in the closed position as shown in FIG. 4 of the drawing.

Referring now to FIG. 4 of the drawing, the construction of an upper portion of the folding guide member 34 is illustrated in detail. The guide member is seen to be of triangular construction and includes conventional truss brace members 52, 54. The folding guide member 34 is also equipped with sheaves 56, 58 and 60 which are coupled in reeved engagement with guy wires 62, 64 and 66. The guy wires 62, 64 and 66 are also coupled to tensioning means 68 as will be described in detail hereinafter. The guy wires 62, 64 and 66 are gathered and constrained by a rigid cable guide loop 70 which is attached to adjacent legs 34A, 34B of the folding guide member 34 as can best be seen in FIGS. 4 and 7.

Figure 7:
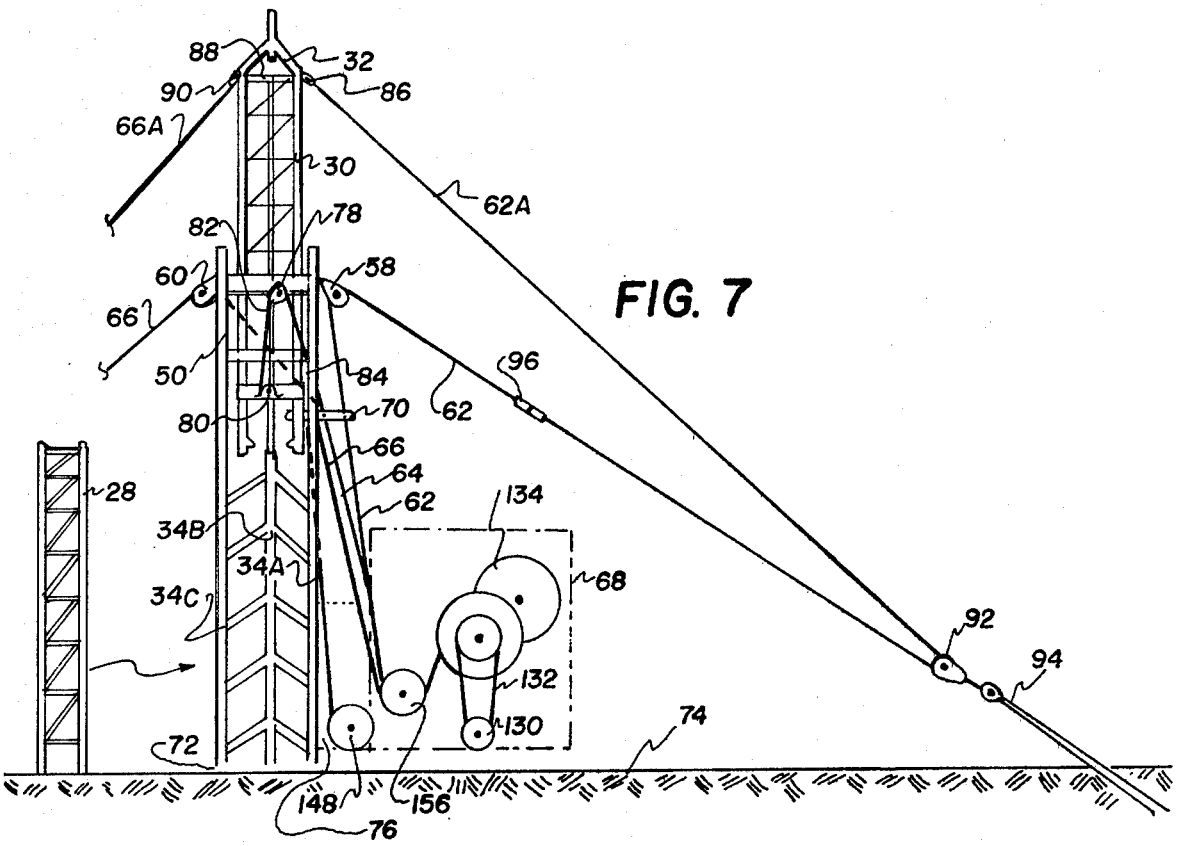
FIG. 7 is an elevation view of the tower assembly and erection apparatus shown in FIG. 3 which illustrates the guy wire in combination with the tension coupling apparatus of the invention.

The leg members 34A, B, C of the folding guide member 34 are secured to a pedestal 72 for direct engagement with the ground surface 74 as can best be seen in FIGS. 3 and 7. The pedestal 72 is preferably easily detachable from the legs 34A, 34B and 34C so that the folding guide member 34 can be removed to allow permanent installation.

Figure 5:
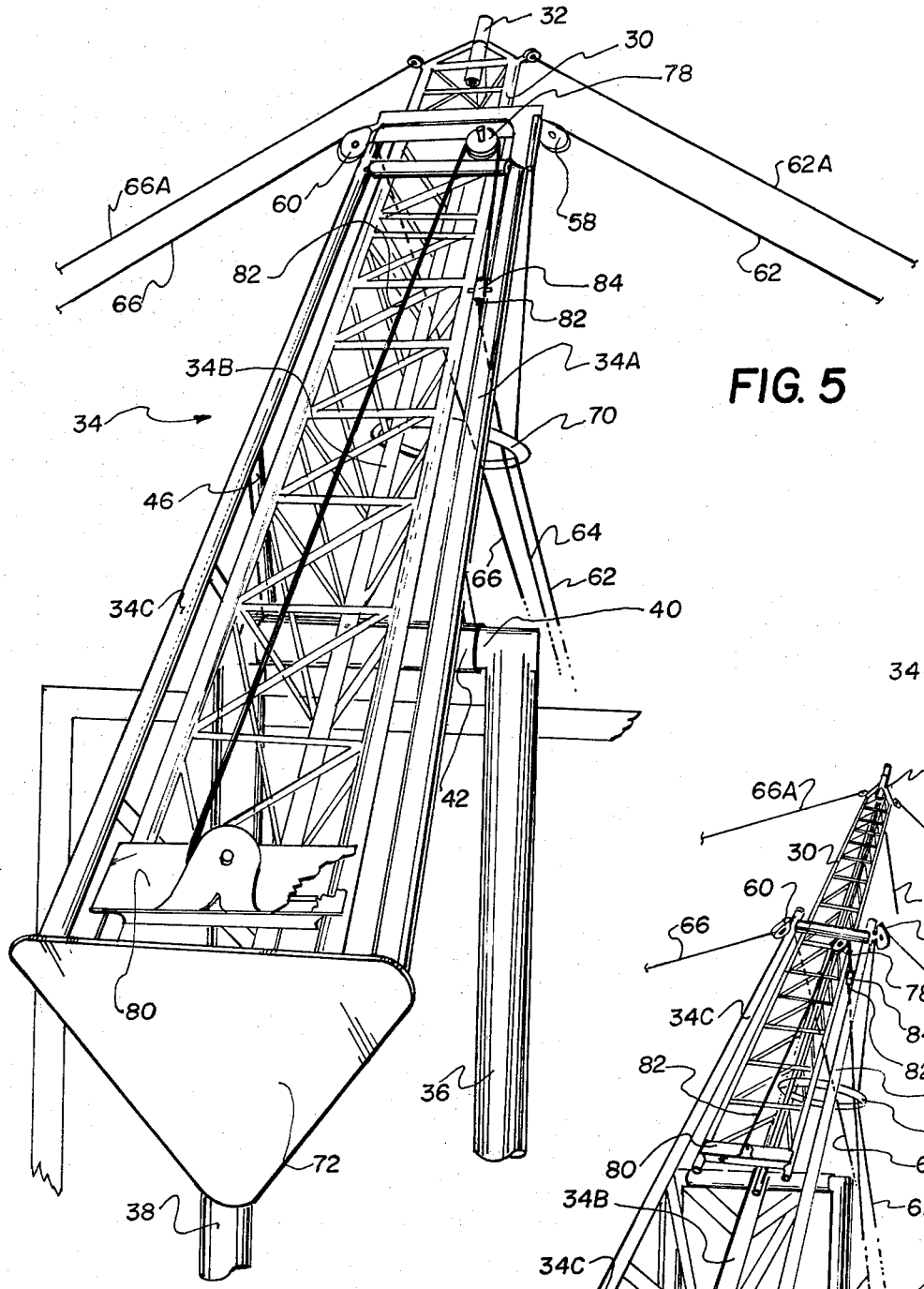
FIGS. 5 and 6 are perspective views of the guide members shown in FIG. 3 which illustrate the hoisting of an upper tower section through the guide members.
Figure 6:
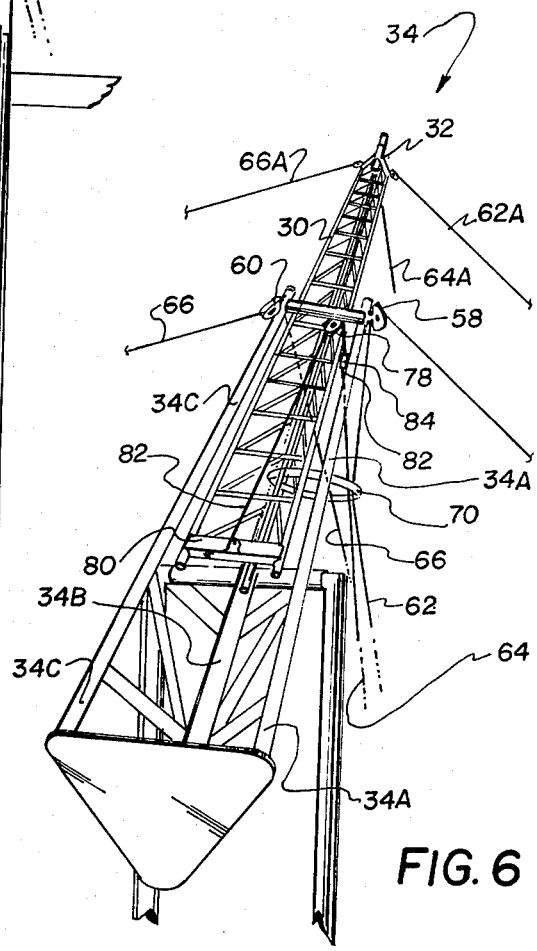

The hoisting procedure will now be described in connection with FIGS. 5, 6 and 7. Individual tower sections are hoisted by means of the winch assembly 76, a housing sheave 78, a hoist bracket 80 and a hoist cable 82 which is connected intermediate the hoist bracket 80 and the hoisting sheave 78 with an intermediate portion being disposed in reeved engagement with the hoisting sheave 78 and also in reeved engagement with an intermediate sheave 84. The hoist cable 82 is also enclosed and constrained by the cable guide loop 70. The uppermost tower section 30 is inserted in an upright position within the folding guide member 34 as indicated in FIGS. 3 and 5. Thereafter, the hoist bracket 80 is attached to a horizontal truss brace member 52 and the gate 50 is securely fastened. Guy wires 62A, 64A and 66A are fastened to eyelets 86, 88 and 90 and are coupled in reeved engagement with anchor sheaves 92 as shown in FIG. 7. The anchor sheaves 92 are tied to anchors 94 which are symmetrically disposed at radially spaced locations in the ground 74 relative to the guide member 34. The free end of guy wire 62A is connected to the free end of guy wire 62 by means of a cable connector 96. As the uppermost tower section 30 is hoisted through the guide member 34, the tensioning means 68 plays out additional lengths of guy wire 62, 64 and 66 under tension as the tower section is extended. After the uppermost tower section has been raised high enough to provide clearance for the insertion of another tower section 28, the winch assembly 76 is temporarily locked against rotation so that the uppermost tower section 30 is maintained in its extended elevated position with a predetermined amount of tension in the guy wires 62A, 62B and 62C. The next lower tower section 28 is then inserted into the guide member, and is attached in end-to-end relation with the uppermost tower section 30.

The assembled sections may be locked temporarily in place on the guide members by suitable fastening means (not shown), or the assembled sections may be lowered to engage the pedestal 72, with the guy wires being maintained under tension. Thereafter, the hoist bracket 80 is manually removed from the upper section and coupled to the lowermost section, thereby permitting the assembled sections to be hoisted to extend the tower and to receive the next lower section.

The additional lengths of guy wire 62A, 64A and 66A can be conveniently carried on a spool assembly 98 as shown in FIGS. 1 and 2 of the drawing. Therefore, the guy wires 62, 64 and 66 are relatively short so that the spool capacity of the tensioning means 68 can be relatively small. For example, for a one hundred foot tower, with anchors 94 disposed approximately seventy-five feet from the guide member 34, less than fifty feet of guy wire need be carried in the tensioning means 68, since each of the remainder lengths 62A, 64A and 66A can be made up from the auxiliary spool assembly 98.

Figure 12:
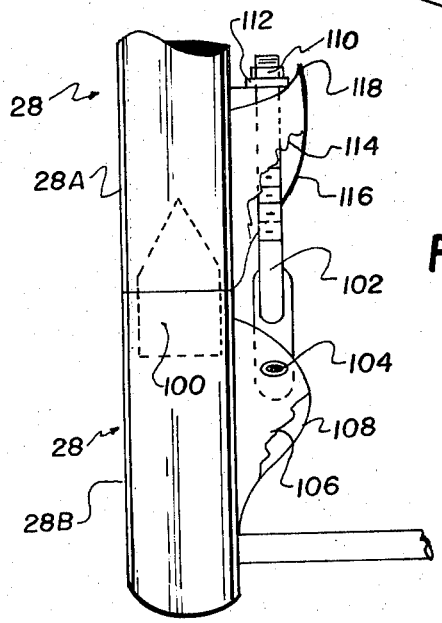
FIG. 12 is an elevation view, partly broken away, of abutting leg end portions and associated fastening apparatus.
Figure 9:
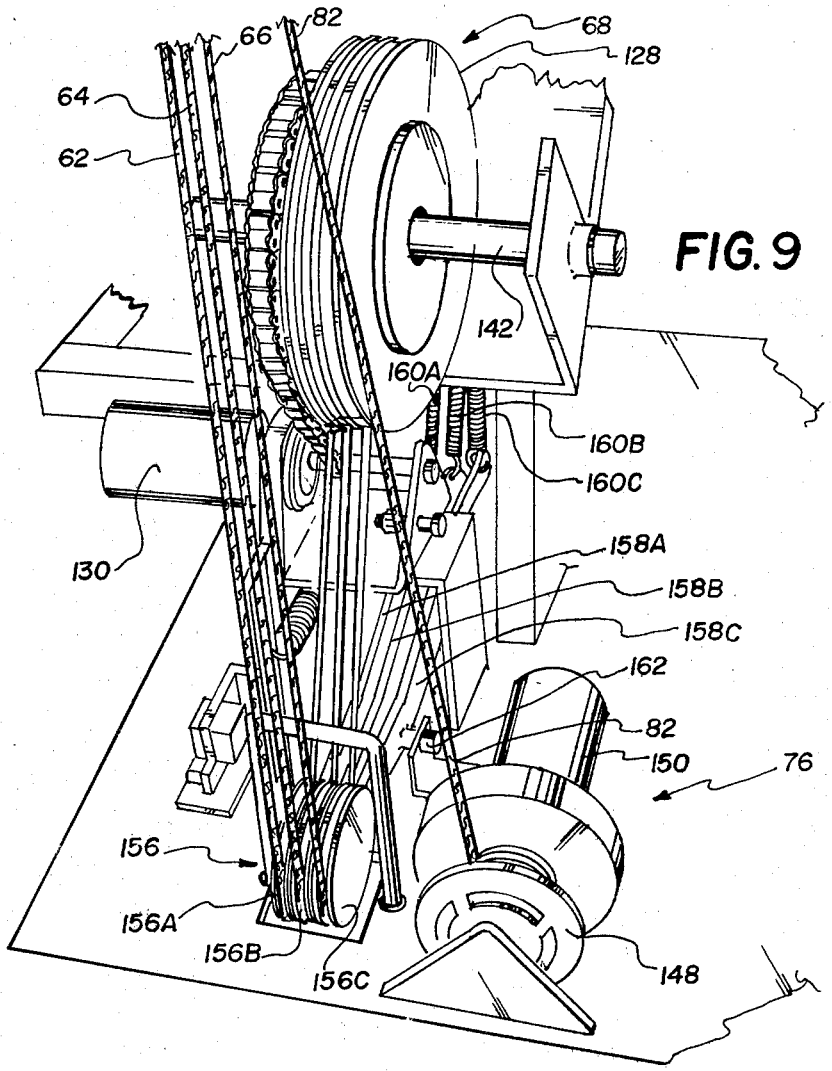
FIG. 9 is a right front perspective view of the tension apparatus shown in FIG. 8.

The tower sections 28 are fastened together preferably as illustrated in FIG. 12 of the drawing. In FIG. 12, abutting leg end portions 28A, 28B are held together in coaxial relationship by means of a centering pin 100. The leg portions are fastened together by means of a threaded fastening bolt 102 which is pivotally connected to a pin 104 carried by a pair of spaced plates 106, 108. The threaded end of the fastener bolt 102 is tensioned by means of a nut 110 which rides on a washer 112 which is held in compressive engagement with the parallel lips of support plates 114, 116. The support plates 114, 116 are spaced in parallel relation defining a channel through which the bolt 102 projects. Each support plate 114, 116 includes a turned-up lip portion 118 which prevents accidental disengagement of the nut and bolt fastener assembly. This fastening arrangement can be easily assembled and disassembled very rapidly.

Figure 11:
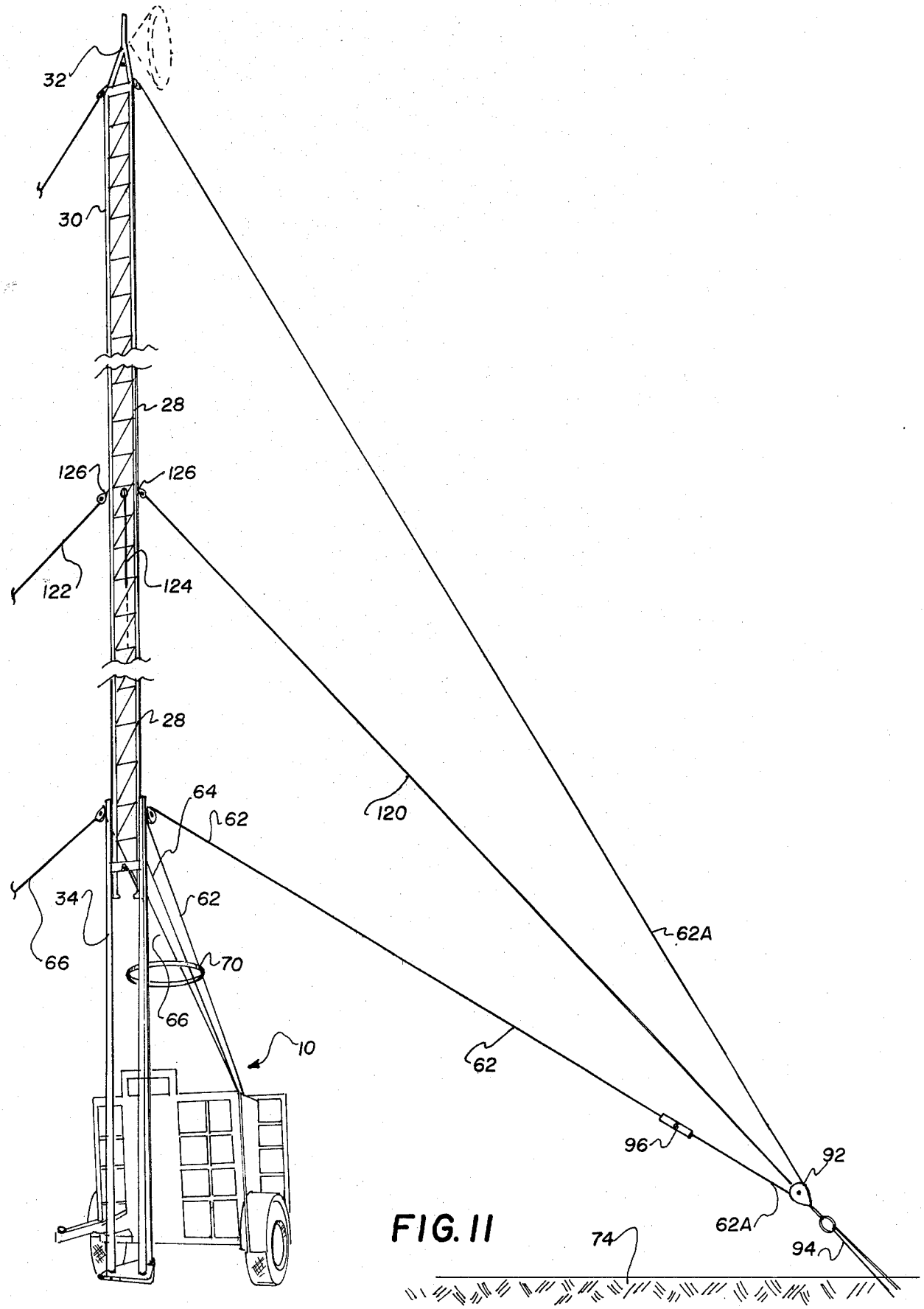
FIG. 11 is an elevation view of a tower assembly erected according to the teachings of the present invention.

The next succeeding tower section 28 is attached to the previously assembled tower sections in end-to-end relation while maintaining the guy wires under tension. The assembled tower sections are then raised through the upright guide member by applying a hoisting force to the lower most tower section while feeding out additional lengths of guy wire under tension as the assembled tower section is extended. These steps are repeated until each of the remaining tower sections 28 have been assembled and the tower has been fully extended. Intermediate guy wires are attached at the appropriate places as the tower is extended. For example, an intermediate group of guy wires 120, 122 and 124 are attached to eyelets 126 as shown in FIG. 11 of the drawing. These intermediate guy wires are tensioned only after the tower has been fully extended. If desired, the opposite ends of the intermediate guy wires may be secured to the anchors 94 or to an independent set of anchors.

According to an important feature of the invention, the guy wires 62, 64 and 66 are played out under tension as the tower sections are extended. This function is carried out by the tensioning means 68 which includes a three-section, slotted winch 128 which is driven by an electric motor 130 which is coupled to the winch by means of a chain drive 132 as shown in FIGS. 7, 8, 9 and 10. As previously discussed, only a relatively short length of each of the guy wires 62, 64 and 66 are wound on the three spool sections of the winch 128. Furthermore, the guy wires are preferably wound one turn on the other within each slot to ensure that the same amount is taken up or let out on each line. A three-section idler wheel 134 engages each of the windings in order to keep the guy wires tightly secured within the winch slots. The idler wheel 134 is depressed against the winding turns by means of a spring 136 one end of which is anchored to a support frame 138 on which the three-section spool 128 turns. The opposite end of the spring 136 is secured to a support frame 140 which supports the idler wheel assembly 134 for pivotal movement relative to the winch 128. The three-section spool assembly 128 rotates on a shaft 142 and the idler wheel assembly 134 rotates on a shaft 144. The support frame 140 is mounted for pivotal movement on a pin 146.

Figure 8:
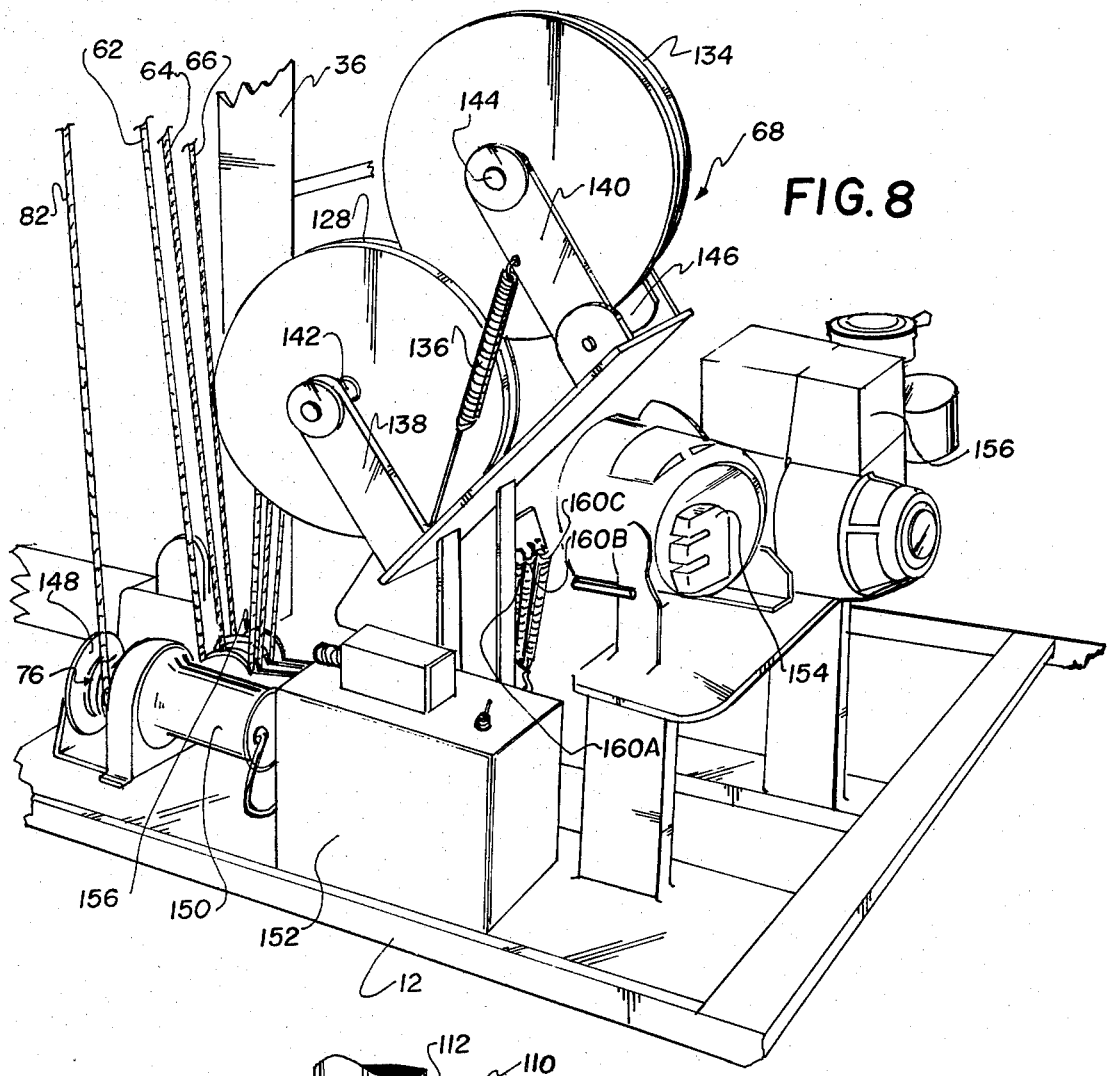
FIG. 8 is a right rear perspective view of the tension apparatus shown in FIG. 7.

As can also be seen in FIGS. 7 and 8, the tower hoist winch assembly 76 includes a spool 148 which is driven by an electric motor 150. Both of the electric motors 130 and 150 are powered by means of a DC storage battery assembly 152. The storage battery assembly 152 is charged by an alternator 154 which is driven mechanically by a small three-horsepower gasoline engine 156. It should be understood that the battery assembly is coupled to the alternator through a conventional voltage regulator (not shown). It should be apparent that the hoist spool 148 and three-section spool assembly 128 could be driven mechanically by means of a small gasoline engine coupled through an appropriate gearing arrangement. However, the electric motor, battery assembly and charger combination is preferable for most applications.

According to an important feature of the invention, the guy wires 62, 64 and 66 are maintained under tension at all times, whether hoisting the tower sections or retracting the tower sections. The guy wires 62, 64 and 66 are coupled in reeved engagement with an intermediate "floating" sheave assembly 156 which includes three separate sheave sections 156A, 156B and 156C. The sheave sections are supported by tension arms 158A, 158B and 158C, respectively, which are coupled to a three section spring assembly 160A, 160B and 160C. The tension arms 158A, 158B and 158C are pivotally mounted on a pin 162 thereby permitting pivotal movement of the floating sheaves 156A, 156B and 156C whereby equal tension loading is maintained on the guy wires by the springs 160A, 160B and 160C.

Figure 10:
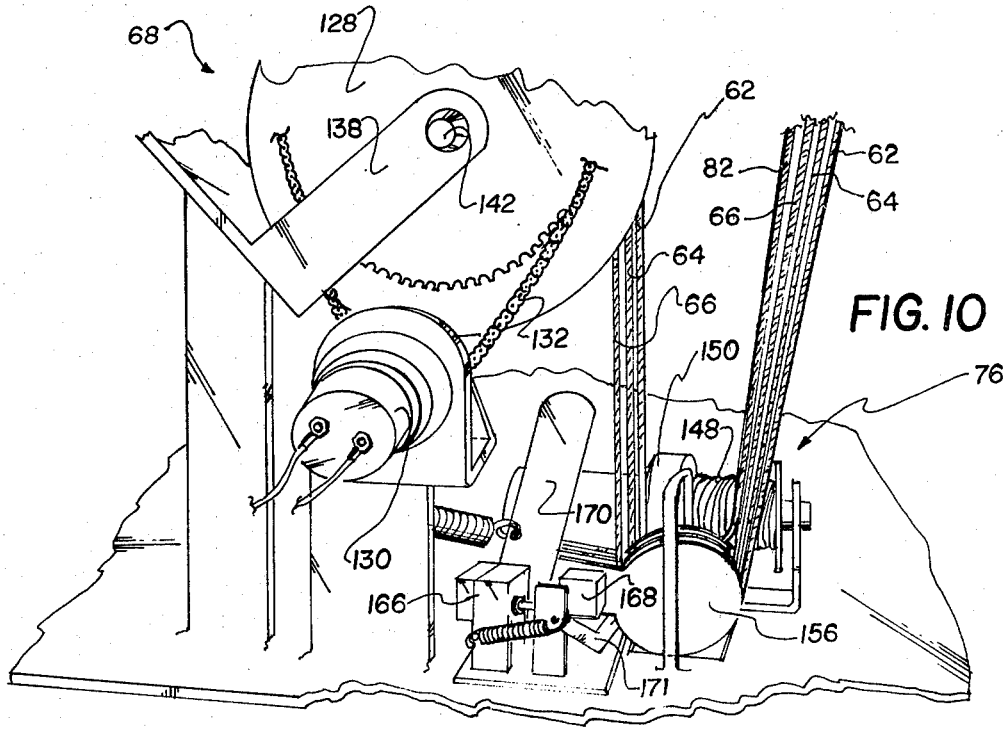
FIG. 10 is a left perspective view of the tension apparatus shown in FIG. 8.

Operation of the electric motors 130, 150 for driving the hoist winch assembly 76 and the guy wire winch assembly 128, respectively, is coordinated by an electrical switch assembly 164 which includes a pair of electrical switches 166, 168 which are spring loaded to the "off" position and an actuator lever 170 which is spring loaded to normally actuate the hoist control switch 166. The actuator lever 170 is pivotally mounted so that upon rotation, the hoist switch 166 is opened and the guy wire control switch 168 is closed. An extension arm 171 of the actuator lever 170 engages each of the tension arms 158A, 158B and 158C and causes angular displacement of the actuator lever 170 in response to movement of the floating sheaves (FIG. 10).

As the tower is lifted, the guy wires will lift the pulleys 156A, 156B and 156C. This permits the spring loaded lever 170 to rotate and trip the electrical switch 166. As switch 166 closes, the winch 130 is operated in reverse to let out an additional length of hoist cable 82 until the sheaves 156A, 156B and 156C move back down and trip the switch 166 to the off position. According to this arrangement all three of the sheaves 156A, 156B and 156C must rotate upwardly in order to cause the winch 76 to let out additional cable. If the tower assembly is being lowered, the floating sheaves 156A, 156B and 156C will move down thereby forcing the lever arm 170 downwardly to trip the switch 168. As switch 168 closes the winch 76 operates to take up hoist cable 82 until all the pulleys lift up and trip the switch 168 off. As the tower assembly is being lowered, downward movement of either one of the floating sheaves 156A, 156B or 156C will cause the switch 168 to trip off. When extending the tower assembly, the winch 76 will only operate when the cable with the most slack is pulled up to cause actuation of the switch 166. If wind loading occurs during the hoisting procedure whereby one or two of the guy lines become very tight or become very slack, the winch will not respond until the slack line or lines are pulled up, then it will let out cable until the switch 166 is tripped off. However, if the tower is being lowered, the slack cable or cables will move down and cause the switch 168 to be tripped and pull in cable until all of the sheaves 156A, 156B and 156C are lifted off of the switch. All three sheaves must be pulled up to cause the winch 76 to let out cable and a single sheave moving down will cause the winch to take up cable.

Although a preferred embodiment of the invention has been described in detail, it should be understood that various changes, substitutions, and alterations can be made therein without departing from the spirit and scope of the invention as defined by the appended claims.

What is claimed is:

1. A sectional tower assembly comprising, in combination:

a plurality of tower sections each triangular in section;

an upright guide member comprising an elongate frame, triangular in section, having side portions enclosing a channel through which a tower section may be extended or retracted, each side of the elongate frame having a plurality of rollers mounted at vertically spaced locations near the upper end of the upright guide member for engaging the exterior of tower sections which are extended or retracted through the channel;

hoist means carried on said guide member for engaging the lower end of a first of each pair of successive tower sections for moving said first tower section to a first elevated position on the guide member to receive a second of each pair of successive tower sections in upright position beneath its lower end;

means engageable with the adjacent ends of successive tower sections for locking the successive tower sections together, end to end, prior to each successive extension of the tower;

a plurality of sheaves attached to the guide member;

a corresponding number of anchors symmetrically disposed at radially spaced locations relative to the guide member and a sheave attached to each anchor;

a winch; and, a plurality of guy wires each having a first end portion attached to said upper tower section, a first intermediate portion coupled in reeved engagement with one of the anchor sheaves, a second intermediate portion coupled in reeved engagement with one of the tower sheaves, and a second end portion coupled to said winch, said winch being operable to maintain a tension load on each guy wire as said assembled tower sections are extended or retracted relative to the guide member.

2. A sectional tower assembly according to claim 1 wherein said winch comprises:

a slotted spool having one slotted section coupled to each of said plurality of guy wires;

driving means coupled to said spool for selectively retracting or playing out said guy wires;

a floating sheave assembly having one section engaging each of said plurality of guy wires intermediate said second end portion and said second intermediate portion, each of said floating sheave sections including a spring tensioned pivot arm biased to move in a first direction when tension on a corresponding guy wire is reduced and in a second direction when tension is increased; and, control means coupled to said spring tensioned pivot arms and to said driving means for, in response to movement of any one of said pivot arms in said first direction, causing said winch to retract said guy wires and, in response to movement of all of said pivot arms in said second direction, causing said which to play out said guy wires.

3. In sectional tower assembly apparatus of the type having an upright guide member and hoist means for raising a first tower section to the top of said guide member, attaching a second tower section to the lower end of said first, raising the second tower section to the top of said guide means, and repeating these steps a preselected number of times, wherein a plurality of guy wires are attached to at least said first section and played out as said tower sections are raised, an improved guy wire winch comprising:

a slotted spool having one slotted section coupled to each of said plurality of guy wires;

driving means coupled to said spool for selectively retracting or playing out said guy wires;

a floating sheave assembly having one section engaging each of said plurality of guy wires intermediate said spool and said at least first tower section, each of said floating sheave sections including a spring tensioned pivot arm biased to move in a first direction when tension of a corresponding guy wire is reduced and in a second direction when tension is increased; and, control means coupled to said spring tensioned pivot arms and to said driving means for, in response to movement of any one of said pivot arms in said first direction, causing said winch to retract said guy wires and, in response to movement of all of said pivot arms in said second direction, causing said winch to play out said guy wires.

* * * * *